US011878233B1

(12) United States Patent
Watry

(10) Patent No.: US 11,878,233 B1
(45) Date of Patent: Jan. 23, 2024

(54) POLE GRIP

(71) Applicant: Dynepic Sports, LLC, Sherwood, OR (US)

(72) Inventor: Krissa Elizabeth Watry, Reno, NV (US)

(73) Assignee: Dynepic Sports, LLC, Sherwood, OR (US)

( * ) Notice: Subject to any disclaimer, the term of this patent is extended or adjusted under 35 U.S.C. 154(b) by 0 days.

(21) Appl. No.: 17/962,815

(22) Filed: Oct. 10, 2022

(51) Int. Cl.
*A63C 11/22* (2006.01)

(52) U.S. Cl.
CPC ..... *A63C 11/2228* (2020.08); *A63C 11/2224* (2020.08)

(58) Field of Classification Search
CPC .. A63C 11/2228; A63C 11/2224; A63C 11/22
USPC ..... 280/821
See application file for complete search history.

(56) References Cited

U.S. PATENT DOCUMENTS 3,290,049 A * 12/1966 McDonald ..... A63C 11/2224 280/821
3,451,688 A * 6/1969 McDonald ..... A63C 11/2224 280/821
3,995,872 A * 12/1976 Joseph ..... A63C 11/2224 280/822
4,252,344 A * 2/1981 Larsen ..... A63C 11/2224 280/822
4,742,837 A * 5/1988 Rise ..... F16M 13/08 135/66
6,644,328 B1 * 11/2003 Lenhart ..... A63C 11/222 52/72
8,123,252 B2 * 2/2012 Lenhart ..... A45B 9/02 280/821
8,276,943 B2 * 10/2012 Best ..... F16F 1/3732 135/65
9,370,685 B2 6/2016 Watry
D782,272 S 3/2017 Watry
10,064,463 B2 * 9/2018 Kreis ..... A63C 11/2224
10,118,084 B2 11/2018 Watry
10,286,251 B2 5/2019 Watry
10,863,804 B2 * 12/2020 Shintani ..... B25G 1/102
11,331,560 B2 * 5/2022 Heim ..... A63C 11/2224
2007/0120353 A1 * 5/2007 Panizza ..... A63C 11/2224 280/821

(Continued)

*Primary Examiner* — John D Walters
*Assistant Examiner* — Hilary L Johns
(74) *Attorney, Agent, or Firm* — Shumaker, Loop & Kendrick, LLP; Michael D. Marra

(57) ABSTRACT

A hand grip system for a skiing, hiking or trekking pole. The pole grip system includes a primary grip with a conical shape designed to fit the natural anatomical shape of a human hand grasping the grip. An optional secondary ascent grip, also conical in shape and located just below the primary grip, may be used for climbing steep terrain without adjusting pole length. The conical shape of the primary grip and the ascent grip provides a mechanism for axial force to be transferred from the user's hand to the pole without requiring a tight grasp. A grip top located above the primary grip prevents the user's hand from sliding upward, and serves as a gripping surface for alternate grasps such as a palm grip. A break-away wrist strap attached at the lower end of the primary grip is usable with either the primary grip or the ascent grip.

22 Claims, 8 Drawing Sheets

(56) References Cited

U.S. PATENT DOCUMENTS

| | | | | |
|---|---|---|---|---|
| 2009/0250917 | A1* | 10/2009 | Lenhart | A45B 9/02 280/821 |
| 2011/0240077 | A1* | 10/2011 | Doherty | A61H 3/02 135/84 |
| 2015/0265906 | A1* | 9/2015 | Takeuchi | G01C 5/06 280/821 |
| 2017/0231339 | A1* | 8/2017 | Kreis | A63C 11/2224 135/76 |
| 2017/0296907 | A1* | 10/2017 | Watry | A45B 9/02 |
| 2019/0216186 | A1* | 7/2019 | Shintani | B25G 1/102 |
| 2020/0069009 | A1* | 3/2020 | Böing | A63C 11/2224 |
| 2020/0352290 | A1* | 11/2020 | Heim | A63C 11/2224 |
| 2021/0228972 | A1* | 7/2021 | Heim | A63C 11/227 |
| 2022/0160086 | A1* | 5/2022 | Chen | A45B 9/02 |

* cited by examiner

POLE GRIP

BACKGROUND

Field

The present disclosure relates generally to an ergonomic and effective hand grip for a pole, such as a hiking, trekking or ski pole. More particularly, the disclosure relates to a pole grip with a conical primary grip designed to fit the natural shape of a human hand and also transfer axial force to the pole from the hand, a conical secondary grip located just below the primary grip, and a break-away wrist strap attached at the base of the primary grip.

Discussion of the Related Art

Hand grips attached to poles for hiking, trekking, skiing, or even just for stability when walking or standing, are used with varying degrees of comfort and effectiveness. FIG. 1 is an illustration of a hand grip 100 of a type known in the art. The hand grip 100 is typical of a design often used on a hiking or ski pole, even though the design is not a particularly desirable shape for optimum comfort or effectiveness. These grips include features such as finger locating bumps (indicated at 110) and indentations (120, 122) in an effort to encourage a certain placement of the hand on the grip during use. However, these design features do little to secure the hand in place when the pole strikes the ground and a load along the axis of the pole is applied to the hand. Prior art hand grips used in other applications—such as walking sticks and canes—have similar grips, and similar problems. Many of these prior art hand grips rely on the user to utilize the strap to react the load of the pole striking the ground. In these cases, many people fail to use the strap correctly to react the load because it is uncomfortable.

Prior art pole grip designs of the type shown in FIG. 1 require the user to tightly wrap their hand around the grip, which causes fatigue from the hand and forearm muscles being engaged. Additionally, achieving a tight grasp can be difficult when wearing the appropriate attire for the activity, e.g., ski gloves. Moreover, it is increasingly difficult to grasp these pole or cane grips when the user has conditions such as arthritis and cannot comfortably form a tight first around the grip. The reason that a tight grasp is required in prior art pole grip designs is that the grip has a shape where the surfaces of the grip are generally parallel to the axis of the pole. This means that reacting to an axial load on the pole—such as when the pole impacts the ground during the course of the activity—can only be achieved by friction forces on the surface of the grip. Friction force is a function of coefficient of friction and normal force, and the normal force is provided by the grasp pressure of the user. Thus, without a tight grasp, there is little friction force available to react to an axial load on the pole. This squeezing force required for a tight grasp causes hand and forearm fatigue which is not ideal in any circumstance, but especially considering that many of the activities using these grips are long duration activities—on the order of hours, if not days.

The hand grip 100 also includes an upper grip stop 130 and a lower grip stop 140. The grip stops are designed to provide a certain measure of axial force and prevent the hand from slipping off of the grip, where the upper grip stop 130 prevents the hand from sliding off the top of the grip and the lower grip stop 140 prevents the hand from sliding off the bottom of the grip. However, the grip stops 130 and 140 concentrate the reaction forces on a small portion of one finger, which is not ergonomically efficient or comfortable for the user.

Furthermore, existing pole grips typically have a wrist strap 150 which is fixedly attached near the top of the grip. Users often place their hand up through the wrist strap 150 and capture the strap 150 between the palm of the hand and a back 160 of the grip. The wrist strap 150 is then used to apply a downward force to the pole when pushing against the ground. The use of the wrist strap 150 in this way is necessitated by the inability of the user to apply a significant downward force to the pole via the grip itself and it uncomfortable on the hand. Many times, users just put their hand through the strap and directly grab the hand grip 100. In this case, the strap 150 does not react the ground impact loads and the hand grip 100 also does not effectively react the load without the user squeezing their hand, ultimately leading to grip fatigue. Also, using the wrist strap 150 in this ineffective hand position on the strap 150 to the hand grip 100 can result in injury to the hand—such as hyperextension of the thumb—if the user falls on the pole, since the hand becomes trapped in the wrist strap 150 and cannot clear the hand grip 100.

In addition to the axial load consideration described above, prior art pole grips of the type shown in FIG. 1 are not designed to fit naturally in a user's grasp, based on the anatomical properties of the human hand when closed gently into a grasping shape.

In view of the circumstances described above, there is a need for an improved pole grip for use on trekking and ski poles and the like.

SUMMARY

The present disclosure describes a grip for an end of a pole, such as a ski pole or a trekking pole. The pole grip includes a primary grip with a conical shape designed to comfortably fit the natural anatomical shape of a human hand grasping the grip, where the conical primary grip may include a spiral groove traversing the outer surface to both wick away moisture and provide physical grip enhancement. An optional secondary ascent grip, also conical in shape, is located just below the primary grip, where the ascent grip may be used for climbing steep terrain without the need to adjust the pole length. The conical shape of the primary grip and the ascent grip provides a mechanism for axial force to be transferred from the user's hand to the pole without requiring a tight grasp. A grip top located above the primary grip prevents the user's hand from sliding upward, and also serves as a gripping surface for alternate grasps such as a palm-down grip. A break-away wrist strap is attached at the base or lower end of the primary grip, where the wrist strap is usable with either the primary grip or the ascent grip, and the break-away design of the wrist strap prevents certain injuries which commonly occur with conventional wrist straps when the user falls on the pole. The pole grip may be provided as a kit which is installed on a user's own poles, or as a complete assembly including a pole with all of the pole grip components installed thereon.

Additional features of the present disclosure will become apparent from the following description and appended claims, taken in conjunction with the accompanying drawings.

DETAILED DESCRIPTION OF THE EMBODIMENTS

The following discussion of the embodiments of the disclosure directed to a pole grip system is merely exemplary in nature, and is in no way intended to limit the disclosure or its applications or uses.

Hand grips for skiing and hiking poles and the like have traditionally been designed with a simple shape intended to position the fingers of the user's hand in a desired location on the grip, but which does little to transfer force from the hand along the axial direction of the pole. As a result, hand grips such as the one shown in FIG. 1 and discussed above use grip stops to prevent the user's hand from slipping off an end of the grip. These grip stops are not particularly effective at transferring high axial forces from the hand to the pole, as is needed when the pole is planted in the ground and pushed against, and the grip stops can create uncomfortable pressure points on the user's hand in some circumstances. In addition, existing hand grips can cause hand fatigue due to the mismatch between the shape of the grip and the natural shape of the user's grasp. Existing hand grips also lack desirable features in the wrist strap.

The pole grip system of the present disclosure is designed to overcome the shortcomings and limitations of existing hand grips for poles. The disclosed pole grip system features a conical grip shape which is designed to match the natural anatomical shape of the user's grasp. This conical shape reduces hand fatigue, and also enables the user to apply an axial force along the length of the pole without requiring excessive squeezing effort. That is, the conical grip shape serves as a wedge which allows the user's hand to apply an axial force (from the smaller diameter end toward the larger diameter end) without having to rely solely on grip pressure and friction or a strap to react the loads. The optimized grip shape in turn enables the wrist strap to be optionally installed and redesigned for user comfort, convenience, operational flexibility and safety. Other elements and features are also incorporated in the pole grip system and discussed below.

Figure 2:
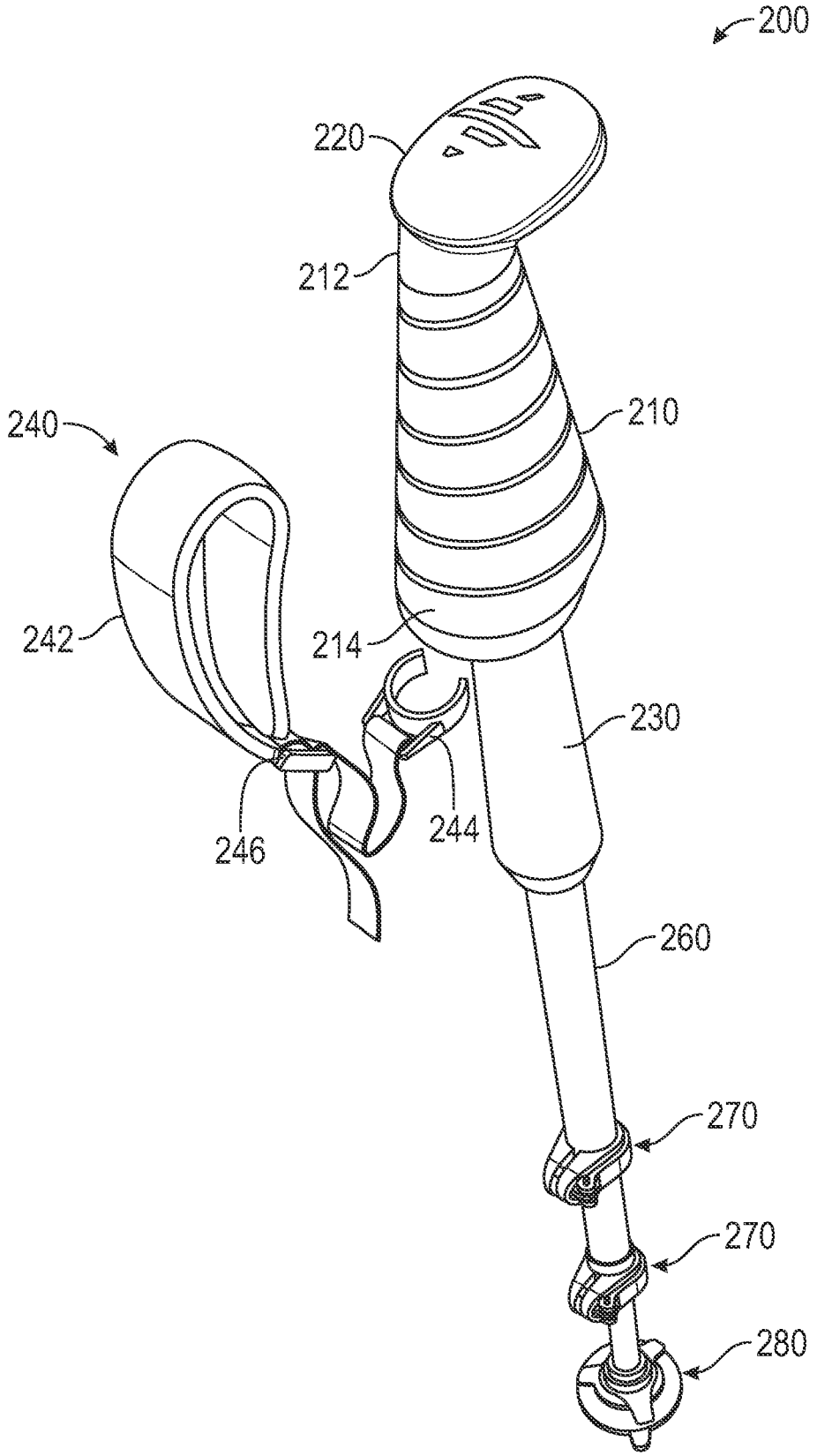
FIG. 2 is an illustration of a pole grip system having a conical primary grip with a multi-purpose grip top, a secondary ascent grip located just below the primary grip and a break-away wrist strap attached between the primary grip and the ascent grip, according to an embodiment of the present disclosure.

FIG. 2 is an illustration of a pole grip system 200 including a primary grip 210 having a conical shape, a multi-purpose grip top 220, a secondary ascent grip 230 located just below the primary grip 210, and a break-away wrist strap 240 attached between the primary grip 210 and the ascent grip 230, according to an embodiment of the present disclosure.

Figure 3B:
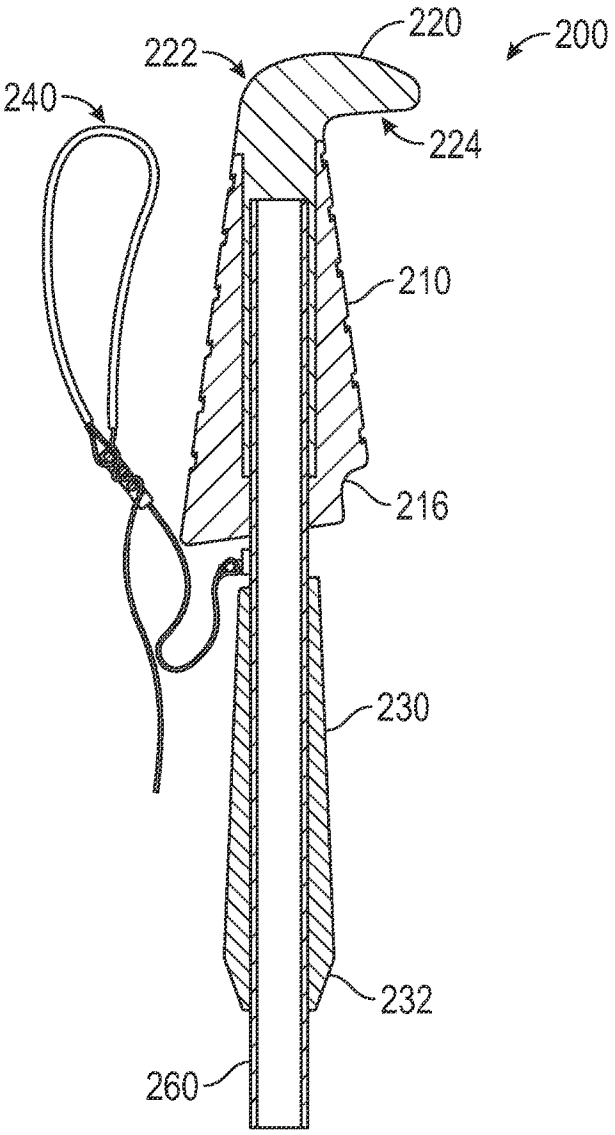
FIG. 3B is a cross-sectional side view illustration of the pole grip system of FIG. 3A, according to an embodiment of the present disclosure.
Figure 3A:
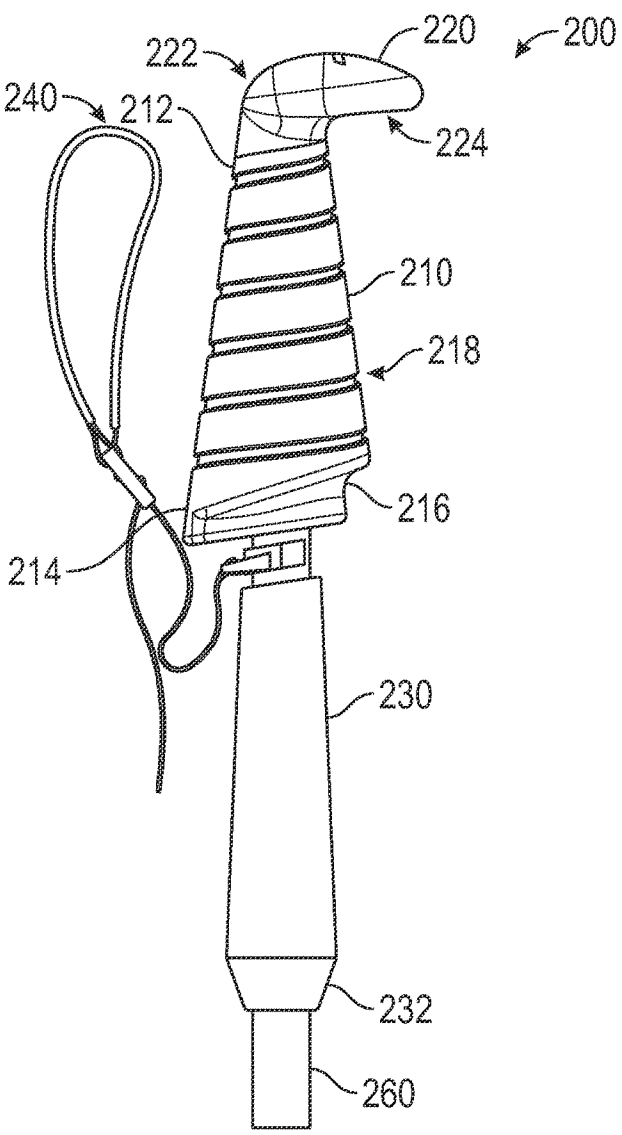
FIG. 3A is a side view illustration of the pole grip system shown in FIG. 1.

FIG. 3A is a side view illustration of the pole grip system 200, and FIG. 3B is a cross-sectional side view illustration of the pole grip system 200, according to an embodiment of the present disclosure.

The pole grip system 200 includes many elements and features which improve the pole usage experience for the user. The primary grip 210 has a conical shape which provides two major advantages. First, the conical shape of the primary grip 210 fits naturally in the hand of the user. The human hand, when closed into a grasping position, does not form a cylindrical shape, but rather naturally forms a conical shape—with the thumb and index finger forming an approximate circle at the top of the grip, and the palm and other fingers approximating a conical shape of increasing diameter going downward from the top of the grip. The primary grip 210 has a conical shape which matches the natural anatomical shape of the hand, thereby increasing hand-grip surface contact, and also reducing fatigue in the user's hand.

The second major advantage of the conical shape of the primary grip 210 is that the conical shape provides a mechanism for axial force to be transferred from the user's hand to the pole without requiring a tight grasp by the user. Many different types of outdoor sports and other activities use a pole for push-off and stability assistance. These activities include hiking, trekking, downhill (Alpine) skiing, cross-country (Nordic) skiing, backcountry skiing, snowshoeing, splitboarding (where a snowboard which is split down the middle is usable as either a snowboard or as a pair of skis), and even simply walking or standing. In any of the pole-assisted activities mentioned above, a downward force must be applied to the pole by the user's hand. This downward force—along the axis of the pole—may be quite large in the case of trekking or skiing, or relatively small in the case of walking. Prior art pole grips of the type shown in FIG. 1 rely on the use of a strap or the friction between the hand and the grip in order to apply the downward force on the pole. The friction is a function of normal force, which depends on grasp pressure.

In contrast, the primary grip 210 of the present disclosure has a conical shape which provides an axial surface area—essentially a wedge—against which the user's hand can bear. Another way to think of this is to imagine a first cone fitted inside of a second cone—where the first cone is physically blocked from moving any further once it contacts the interior surface of the second cone. This same effect applies to the conical primary grip 210 when it is fitted inside the grasp of the user's hand.

Friction forces between the user's hand and the primary grip 210 also come into play, and further increase the transfer of axial force from the hand to the grip (and thus the pole). Friction forces may be enhanced by way of material selection for the primary grip 210 (including surface tackiness and/or a slight compressibility of the material), and also by way of shape features on the surface of the primary grip 210—both of which are discussed below.

The primary grip 210 has a top end 212 and a bottom end 214. The top end 212, which is the smaller diameter portion of the conical shape, is proximal the top end of the pole to which it is fitted. In a preferred embodiment, the top end 212 has a diameter (just below the grip top 220) of about 1", plus or minus about 0.25". The 1" diameter of the top end 212 corresponds with the natural size of the grasp (the ring formed by the thumb and forefinger) by the hand of the majority of users. Larger and smaller diameters at the top end 212 are of course possible.

The bottom end 214 is the larger diameter portion of the primary grip's conical shape. The primary grip 210 has a preferred "length" (from the top end 212 to the bottom end 214) of about 5", not counting the height of the grip top 220. This grip length is designed to accommodate the width of the hand of most users. Grip lengths in a range from about 4-6" may be suitable in various applications. The primary grip 210 has a cone angle in a range from about 10-35°, with a preferred angle between 15-20°. In a most preferred embodiment, the primary grip 210 has a cone angle (the total included angle from outside surface to outside surface) of about 16°. Thus, the angle from the pole centerline to an outside surface of the primary grip 210 is about 8°, and in a particularly preferred embodiment this angle is 7.94°. The aforementioned dimensions result in the bottom end 214 having a diameter of about 2.5", plus or minus a small amount. Again, the bottom end diameter of about 2.5" corresponds with the natural size of the grasp by the hand of the majority of users (the lower portion of the grasp formed by the outer edge of the palm and the pinky finger, which naturally form an arc).

The conical portion of the primary grip 210, from the top end 212 down to the bottom end 214, is considered the grip body. Thus, the primary grip 210 in its entirety comprises the grip body and the grip top 220.

The cone angle of the primary grip 210 (e.g., 16°) is large enough to allow the user to apply a substantial axial thrust force to the pole without having to grasp tightly to create a friction force. This natural mechanism for applying a thrust force to the pole, without relying on friction, is a major advantage of the conical shape of the primary grip 210. Although larger cone angles for the primary grip 210 would increase the amount of axial surface area against which the user's hand could provide a thrust force, larger cone angles would also increase the weight of the pole grip system 200, and deviate from the natural shape of the user's hand in a grasping position.

The grip system 200 may be made in smaller youth and intermediate sizes to accommodate smaller hands, where all of the lengths and diameters discussed above would be reduced appropriately, and the cone angle would remain in the 15-20° range.

The primary grip 210 has a notch 216 extending around most of the circumference of the lower end 214, as shown best in FIG. 3A. The notch 216 is largest (in both height and depth of cut) at the front face of the primary grip 210. The front face is the portion of the primary grip 210 which is facing in the direction the user is traveling when using a conventional or regular grasp; this is located at the right in FIG. 3A, underneath a front overhang 224 discussed later. The circumferential shape allows the notch 216 to be used for a "pinky lift", where the little finger (pinky) is curled into the notch 216 and used to aid in lifting the pole. In this hand position the hand has a very relaxed open grip that can react the ground impact load but also easily lift the pole in preparation for the next step.

In a preferred embodiment, a spiral groove 218 is formed in the outer surface of the primary grip 210, running continuously in a spiral or helical shape from the top end 212 to the bottom end 214 as shown. The spiral groove 218 serves to wick or channel moisture (rain, snow, perspiration, etc.) away from the hand or glove of the user, thereby maintaining a drier grip surface and a more secure grasp. The spiral groove 218 also provides additional mechanical grip enhancement, as the hand or glove of the user will deform into the groove 218 slightly under normal grasp pressure.

The pole grip system 200, and the primary grip 210 in particular, must be designed to withstand the rigors of outdoor activities such as trekking and snow skiing. This implies a number of requirements which must be met by the pole grip system 200 and the primary grip 210—including being waterproof, generally impervious to dirt and dust, durability over years of usage, and ability to withstand impacts with the ground and rocks.

A variety of materials may be used for the primary grip 210, and the optimal material selection may depend on the activity for which the pole/grip are being used (snow skiing, hiking, walking, etc.). The primary grip 210 must largely maintain its shape in the user's grasp; that is, the grip material must not be too "squishy" or compressible. On the other hand, it is not desirable for the primary grip 210 to be extremely hard or slick. The ideal properties of the primary grip 210, for most usage applications, are a slight amount of compliance or compressibility and some degree of surface tackiness. In addition, the primary grip 210 must be as light in weight as possible, as pole/grip weight (lighter is better) are a primary consideration in long-duration activities such as trekking and cross-country skiing.

The properties described above may be achieved by constructing the primary grip 210 of natural cork or EVA (ethylene-vinyl acetate) foam, or a combination of rubber or soft plastic with cork or EVA foam. The aforementioned materials are particularly suitable to trekking or hiking activities. For snow skiing and other snow sports where moisture is unavoidable, a combination of a durable plastic with rubber, silicone rubber or an elastomer such as a TPE (thermoplastic elastomer) may be used, where the harder plastic would be used for inner parts of the primary grip 210 and the rubber or TPE would be used for the outer grip surface. Other materials may be used as suitable based on their hardness, durability, density, surface friction properties, ability to withstand moisture and impacts, etc.

The grip top 220 has a size and shape specifically designed to match certain grasp styles by the user (discussed below), thus enhancing the performance of the pole-grip combination and the comfort for the user. One feature of the grip top 220 which is highly advantageous in several of the grasp styles is a blend surface 222 which provides a transition from a top surface of the grip top 220 to a trailing (or rear) surface at the top end 212 of the primary grip 210. The blend surface 222 is a smooth, continuous blend—with no overhang of the primary grip 210 in the trailing direction. The reasons for the blend surface 222 being designed this way—relative to both performance and comfort—will be discussed with respect to the various grasp styles below.

The grip top 220 further includes a front overhang 224, which is also designed for performance and comfort in various grasps. A bottom surface of the front overhang 224 serves as a top grip stop and hand positioning feature for a conventional grasp, where the bottom surface of the front overhang 224 provides a large surface area for lifting the pole with the top of the user's index finger. A top surface of the grip top 220 is designed with a rounded shape to fit the palm of the user's hand when using a "palm grip", where the user achieves forward thrust by pushing down on the grip top 220 with the pole angled down and rearward to the tip which is planted in the ground. These features of the grip top 220 and their relevance to the various grasp styles are also discussed further below. The grip top 220 may be constructed of the same material as the primary grip 210, or the grip top 220 and the primary grip 210 may be made of different materials. One-piece and two-piece construction embodiments are discussed below.

The ascent grip 230 is an optional element of the pole grip system 200. The ascent grip 230 is particularly useful in activities involving uphill climbing—such as trekking and some types of backcountry skiing. A shorter pole length is desirable when planting the pole during uphill climbing. This is one reason for poles having adjustable lengths. However, it is inconvenient for the user to adjust the pole length, and therefore this is usually only done prior to a prolonged period of uphill climbing. In more typical conditions, where short periods of uphill climbing are interspersed with traversal of flat or downhill terrain, it is far easier for the user to simply grasp the ascent grip 230 to effectively shorten the pole length for the uphill climbs.

The ascent grip 230, like the primary grip 210, also has a conical shape. The ascent grip 230 has a length (along the axis of the pole) of about 5 inches, more or less, which is designed to fit the width of the human hand. In a preferred embodiment, the ascent grip 230 has a top diameter of a little less than an inch—such as about 0.9 inches. The ascent grip 230 has a cone angle of about 4-5°, which is considerably less than the cone angle of the primary grip 210; this is so that the ascent grip 230 is less bulky, which makes it less of a hindrance to clipping two poles together, and allows it to be lighter in weight, among other advantages. In a preferred embodiment, a conical chamfer 232 is provided at the lower end of the ascent grip 230, to provide a transition in size back to the pole diameter.

The ascent grip 230 may be constructed of a material such as EVA foam or cork, preferably a single piece of material which is slipped or pressed into position on the pole and bonded in place. Other construction embodiments may also be suitable, such as a two-piece clamshell design which could be installed on a pole which already has the primary grip 210 installed.

A pole 260 is not part of the pole grip system 200 per se, but is used with the pole grip system 200. A pole including all of the components of the pole grip system 200 may be assembled and sold as a complete product, or the components of the pole grip system 200 may be sold as a kit which can be installed onto a user's own poles. In applications such as trekking, the pole 260 may include clamps 270 at one or more locations to allow for length adjustment. For other activities, the pole 260 is a single piece, not adjustable in length. The pole 260 may be made of carbon fiber tube, aluminum tubing, solid wood, bamboo, a composite material, or other rigid material with proper strength for the activity and forces applied. The pole 260 has a tip end 280 usually including a hard tip to penetrate the ground surface and a "basket" or cup-shaped element to prevent the tip end 280 from penetrating too far into soft soil or snow. For canes and walking sticks, the tip end 280 typically includes a simple rubber cap rather than the hard tip and the basket.

The break-away wrist strap 240 is detachably connected to the pole 260 between the primary grip 210 and the ascent grip 230, as shown in FIG. 3A. The break-away wrist strap 240 is shown in a detached position in FIG. 2. The break-away wrist strap 240 includes a loop portion 242 and a clip 244, among other elements. The user places their hand through the loop portion 242 so that the loop portion 242 is positioned over the user's wrist. The user can then grasp either the primary grip 210 or the ascent grip 230, because both are equally accessible based on the attachment location of the wrist strap 240 to the pole 260. This is in contrast to the traditional pole grip 100, where the wrist strap 150 is attached at the top of the grip handle and must be removed from the wrist if the user wishes to grasp the pole below the grip handle. A buckle 246 is also provided for adjustability of the break-away wrist strap 240.

The clip 244 enables the break-away wrist strap 240 to be reliably attached to the pole 260 when desired, and to be detached from the pole 260 when not wanted by the user. Very significantly, the clip 244 enables the break-away wrist strap 240 to detach from the pole 260 in the event that the user falls and a force is applied to the loop portion 242 pulling the wrist strap 240 away from the pole 260. This is a scenario which commonly occurs when the user falls on the pole 260. With traditional fixed wrist straps if the user grabs the pole through the strap, when the user falls on the pole, the user's hand is trapped in the wrist strap and is forced into the ground, sometimes in an awkward position and with the user's body weight landing on top, which can result in "skier's thumb" (jamming or hyperextension of the thumb) or other injuries. In contrast, the wrist strap 240 is configured at the base of the grip 210 which allows the hand to naturally clear the pole grip if the user falls, thus preventing injuries resulting from the user's hand from being trapped against the pole or the ground in a fall. As added safety feature, the break-away wrist strap 240 breaks free under tension and allows the hand to decouple from the pole 260 altogether. In addition, the break-away feature of the wrist strap 240 allows the use of the hand (free of the pole) to brace the user in the fall—such as to prevent the head from striking the ground.

The clip 244 is designed to provide a break-away force in a desired range, where the clip 244 does not detach unintentionally, but the clip 244 reliably detaches in the event of a fall. Other attachment means between the break-away wrist strap 240 and the pole 260 may be used as suitable. The break-away wrist strap 240 is connected to the pole 260 just below the primary grip 210, regardless of whether the (optional) ascent grip 230 is used. Additional design and construction details of the break-away wrist strap 240 are discussed later in connection with FIG. 6.

Figure 4B:
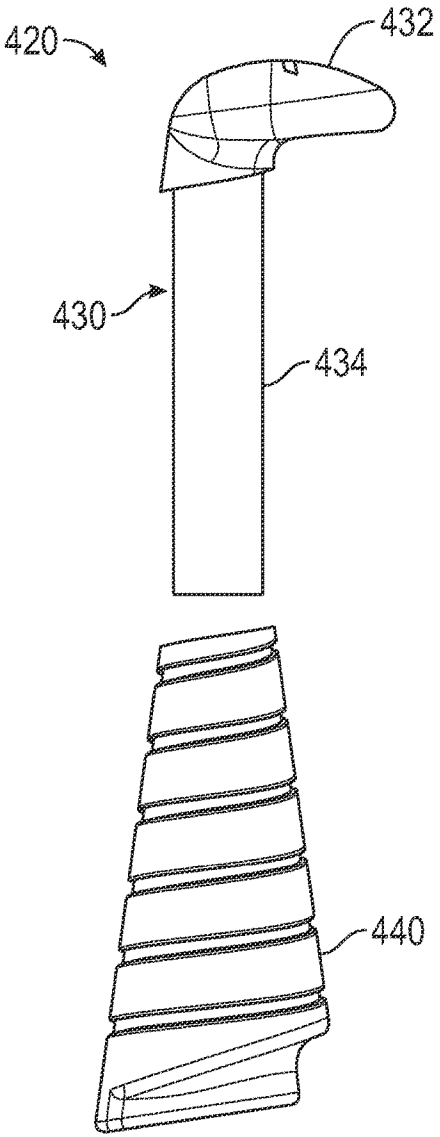
FIG. 4B is a side view illustration of a two-piece design of the primary grip of the pole grip system, according to embodiments of the present disclosure.
Figure 4A:
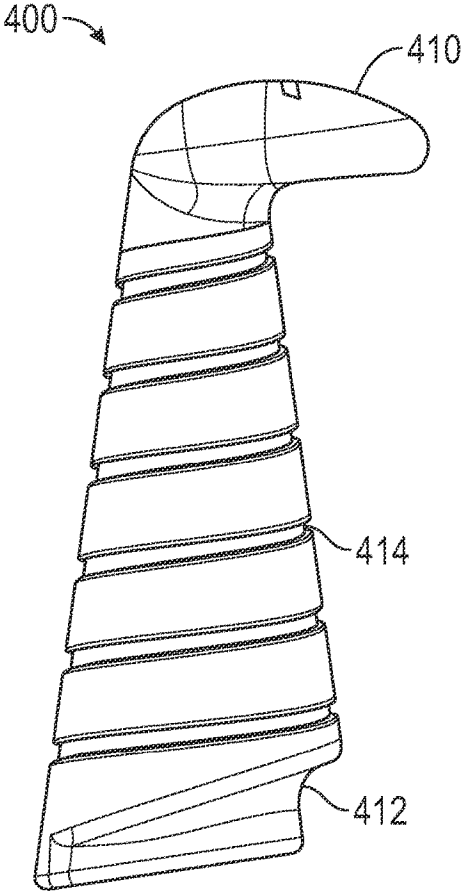
FIG. 4A is a side view illustration of a single-piece design of the primary grip of the pole grip system.

FIG. 4A is a side view illustration of a single-piece design of the primary grip of the pole grip system 200, and FIG. 4B is a side view illustration of a two-piece design of the primary grip of the pole grip system 200, according to embodiments of the present disclosure. A one-piece primary grip 400 is shown in FIG. 4A, and is an embodiment of the primary grip 210 shown in FIGS. 2 and 3 and described above. The one-piece primary grip 400 may be made of cork, EVA foam, rubber or a rubber-like plastic. A composite construction is also possible—such as an inner core molded of a harder plastic material with an outer body over-molded in EVA foam or the like. The one-piece primary grip 400 could even be 3D printed of any suitable material or combination of materials. The one-piece primary grip 400 includes an integral grip top 410, and also includes a notch 412 for the pinky finger lift as discussed earlier. A spiral groove 414 is shown traversing the surface of the one-piece primary grip 400, as also discussed above. The one-piece primary grip 400 is installed by sliding the grip 400 over the top end of the pole 260, where the grip 400 is coupled to the pole 260 by press fit (friction) or by bonding with an adhesive.

A two-piece primary grip 420 is shown in FIG. 4B, and is another embodiment of the primary grip 210 shown in FIGS. 2 and 3 and described above. The two-piece primary grip 420 comprises two parts; a pole coupler 430 with integrated grip top 432, and a grip body 440. The pole coupler 430 is a single piece including the grip top 432 and a coupler sleeve 434. The pole coupler 430 may be constructed of a durable and somewhat rigid material—such as rubber, plastic or TPE. The grip body 440 may be constructed of cork or EVA foam, for example, and is preferably made of a lighter (less dense) material compared to the pole coupler 430. For installation of the two-piece primary grip 420, the grip body 440 is fitted over the coupler sleeve 434 of the pole coupler 430, and the coupler sleeve 434 is fitted over the top end of the pole 260, where both of these assembly steps may be a press fit or may use an adhesive.

In both the one-piece and two-piece embodiments of the primary grip, the pole 260 is fitted into a hole in the lower end of the primary grip (400 or 420) such that the pole 260 extends most of the way up to the top end 212 (FIG. 2), but does not penetrate through the top of the grip top 220.

FIGS. 5A-5H are illustrations of a human hand grasping the primary grip 210, the ascent grip 230 or the grip top 220, depicting different types of grips or grasps which are possible using the pole grip system 200, according to embodiments of the present disclosure. The pole grip system 200 is designed to accommodate the multitude of grasp types depicted in FIGS. 5A-5H because users want to be able to move their hands into different grasp positions in order to reduce fatigue while trekking or climbing. Additionally, some grips are better for certain situations or activities; for example, level cross-country skiing may call for a different grasp type than downhill or slalom skiing, and uphill climbing may call for a different grasp type than mall walking.

Figure 5C:
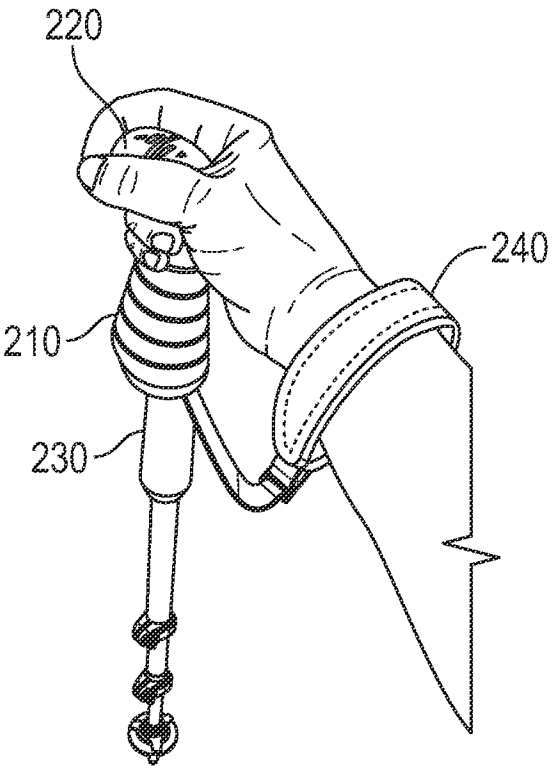
FIGS. 5A-5H are illustrations of a human hand grasping the primary grip, the ascent grip or the grip top, depicting different types of grips which are possible using the pole grip system, according to embodiments of the present disclosure.
Figure 5B:
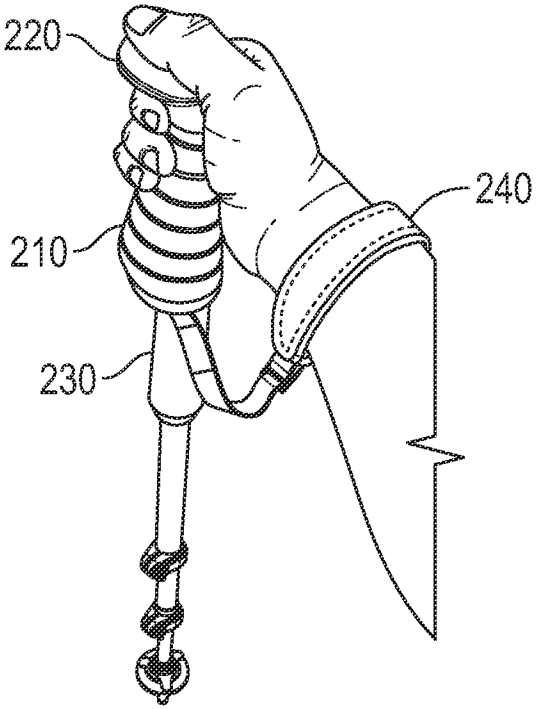
Figure 5A:
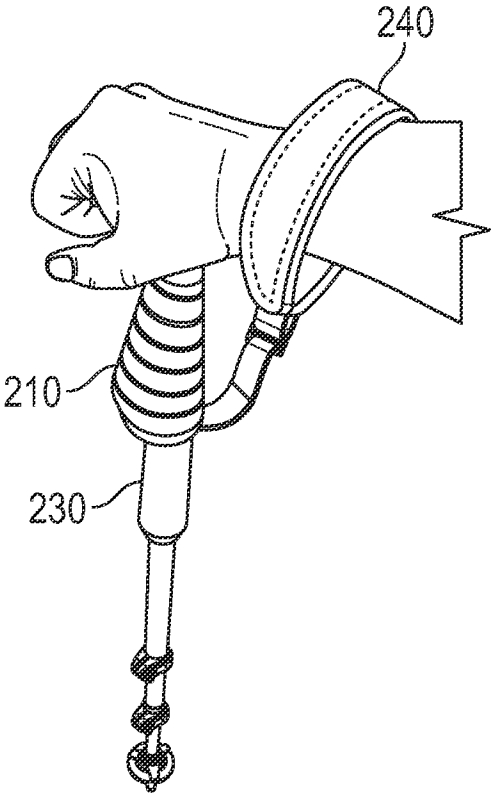

FIG. 5A illustrates a palm grip, where the hand is placed, palm down, on top of the grip top 220. The grip top 220 (not shown, obscured by hand) is designed with a rounded "dome" shape on top to accommodate the palm grip as shown in FIG. 5A. The palm grip is often used in steep climbs while hiking, and in certain cross-country skiing situations.

FIG. 5B illustrates a "power thumb grip", where the thumb is positioned on top of the grip top 220 and the fingers are wrapped around the upper portion of the primary grip 210. The rounded shape of the top of the grip top 220, along with the blend surface 222 (FIG. 3A)—a smooth, continuous blend with no rear overhang—provide a natural fit to the user's hand when using the power thumb grip as shown in FIG. 5B. The power thumb grip may be used as an alternate to a standard or regular grip in certain hiking, trekking and skiing situations—enabling the user to change hand grasping positions at intervals over the course of a long-duration activity.

FIG. 5C illustrates a "trigger grip", where the forefinger is wrapped around the periphery of the grip top 220 and curled into a trigger position at the leading edge, with the thumb also wrapped around the edge of the grip top 220 opposite the forefinger, and the other fingers are wrapped around the upper portion of the primary grip 210. The smooth, continuous blend with no overhang at the rear of the grip top 220 provides a comfortable fit to the user's hand when using the trigger grip as shown in FIG. 5C. The trigger grip may be used as an alternate to a regular grip or the power thumb grip in certain hiking, trekking and skiing situations.

The wrist strap 240, with its attachment location just below the primary grip 210, can easily accommodate all of the grasps shown in FIGS. 5A-5C.

Figure 5E:
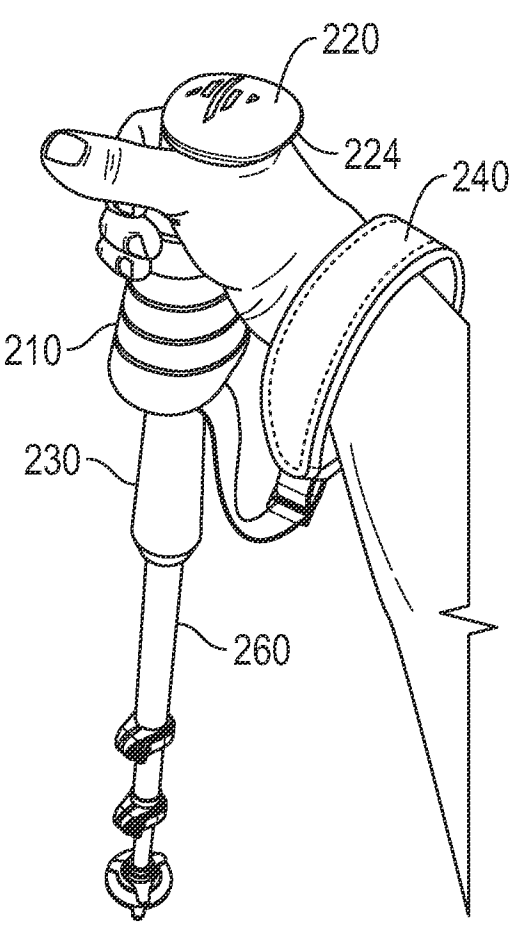
Figure 5D:
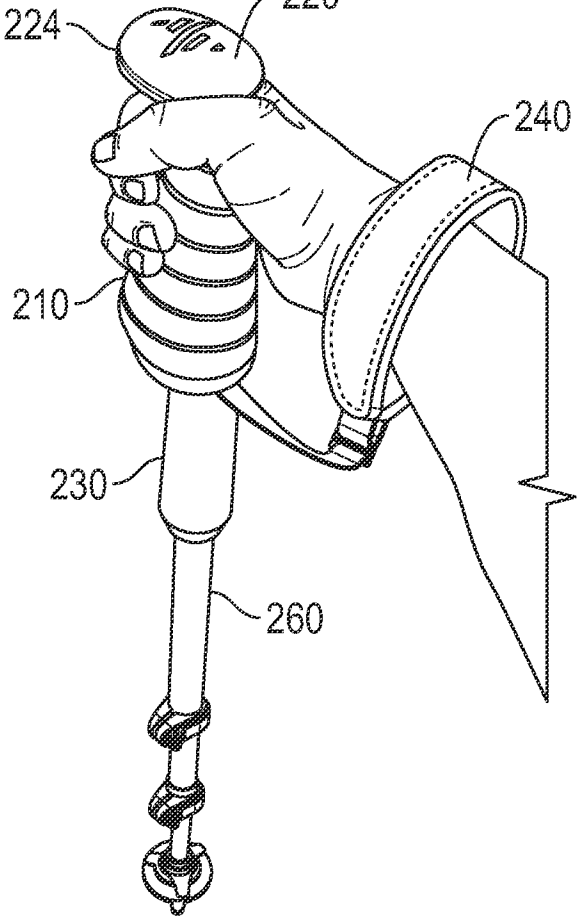

FIG. 5D illustrates a standard or regular grip, where the fingers are wrapped around the primary grip 210 and the thumb is wrapped around the opposite side of the primary grip 210, with the front overhang 224 of the grip top 220 pointing forward (in the direction of travel). The conical shape of the primary grip 210 provides a natural fit to the user's hand when grasping with the regular grip as shown in FIG. 5D. The regular grip is commonly used in many hiking, trekking and skiing situations—where the primary grip 210 offers a relaxed and ergonomic hand pose while providing a natural mechanism for delivering axial force from the hand to the pole 260.

FIG. 5E illustrates a "switch grip", where the fingers are wrapped around the primary grip 210 and the thumb is wrapped around the opposite side of the primary grip 210, with the front overhang 224 of the grip top 220 pointing rearward (opposite the direction of travel). The switch grip is an alternative to the regular grip which has a slightly different feel to the user, while still offering all of the comfort and performance benefits of the conical shape of the primary grip 210.

The wrist strap 240, with its clip attachment to the pole 260, can rotate around the pole 260 to accommodate either the regular grip of FIG. 5D or the switch grip of FIG. 5E.

Figure 5H:
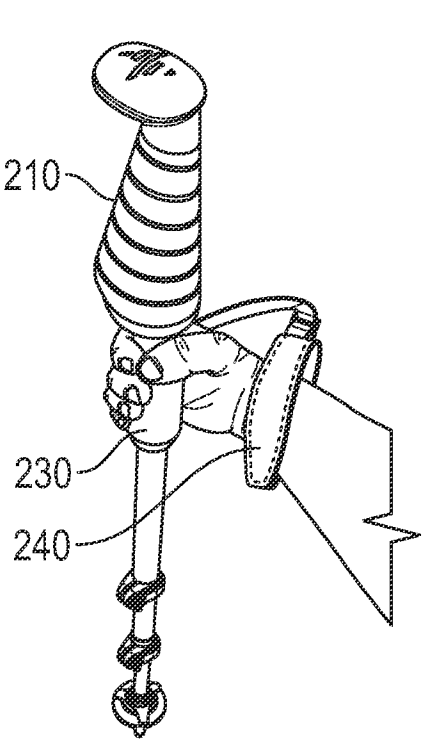
Figure 5G:
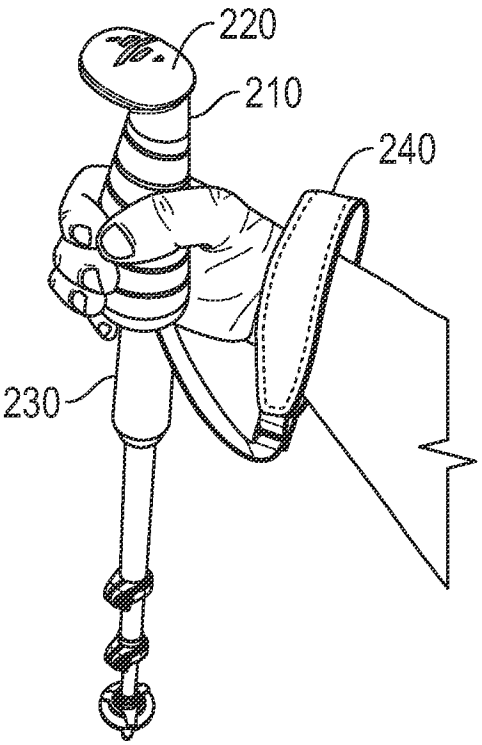
Figure 5F:
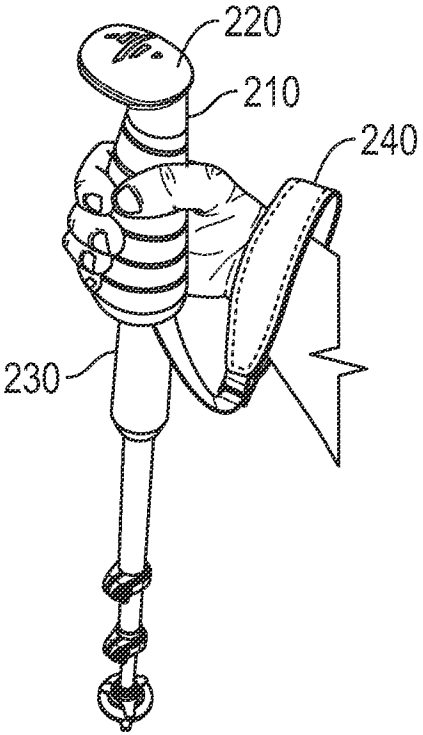

FIG. 5F illustrates a "pinky lift" grasp, where the little finger ("pinky") is wrapped around the front of the primary grip 210, in the notch 216, and the other fingers are wrapped around the lower portion of the primary grip 210, with the thumb wrapped opposite the fingers. FIG. 5G illustrates a "two finger lift" grasp, which is similar to the pinky lift except in the two finger lift it is the ring finger which is positioned in the notch 216, with the pinky below the ring finger. The notch 216 is designed—in depth, width and curvature—to comfortably wrap a finger into, while other fingers grasp the body of the primary grip 210. The pinky lift and two finger lift grasps are useful when the user wants the most open, relaxed hand position.

Figure 1:
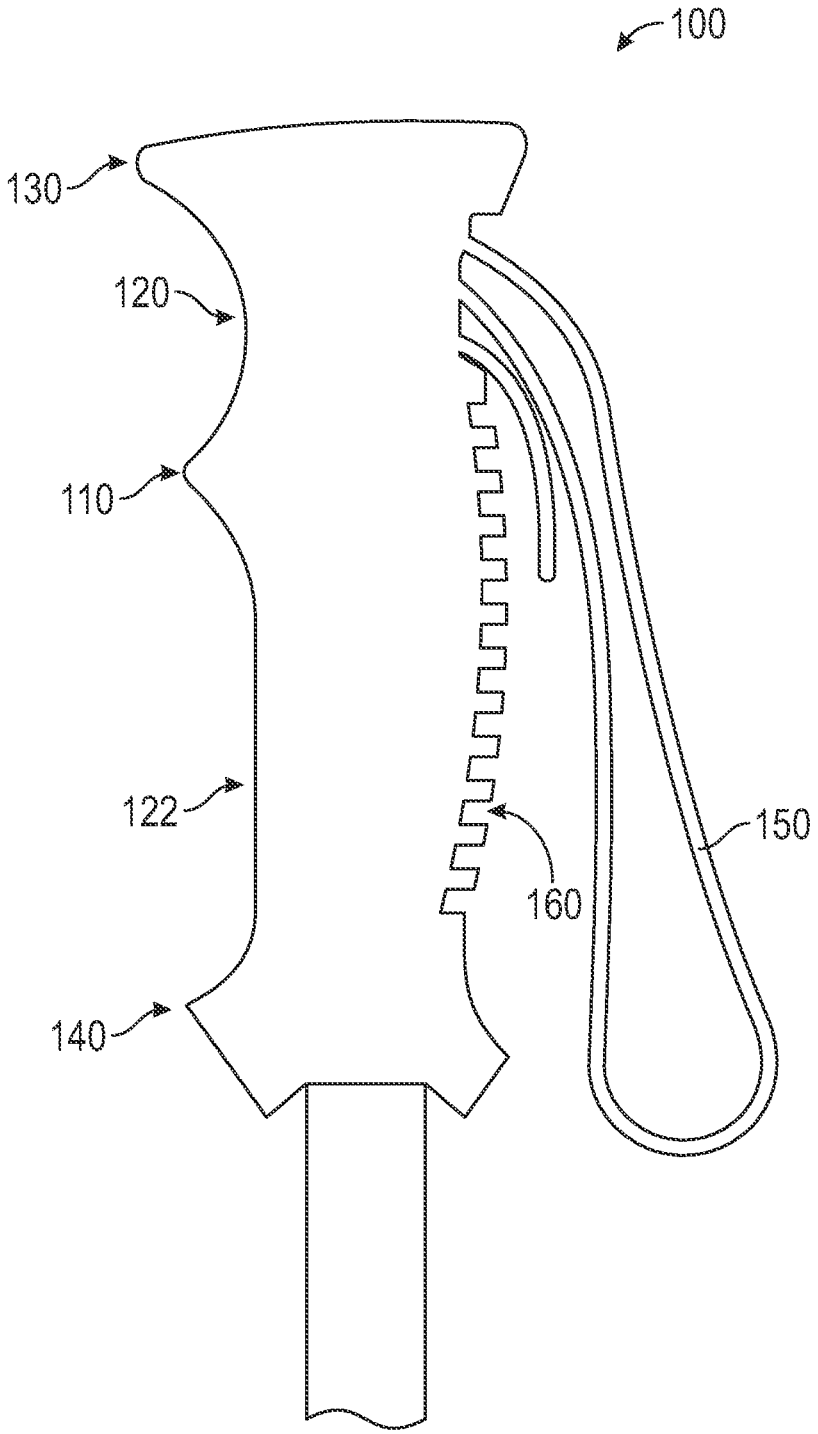
FIG. 1 (Prior Art)
FIG. 1 is an illustration of a conventional hand grip of a type used on ski poles and hiking poles, as known in the art.

FIG. 5H illustrates a regular grasp on the ascent grip 230, where the fingers are wrapped around the ascent grip 230 and the thumb is wrapped around opposite the fingers. The conical shape of the ascent grip 230 provides the same comfort and performance advantages as the primary grip 210. Although the ascent grip 230 is an optional component of the pole grip system 200, it is useful in situations where a shorter effective pole length is desired—including moderate ascents in hiking and trekking. The wrist strap 240, with its attachment location just above the ascent grip 230, can easily accommodate the grasp shown in FIG. 5H, while a conventional wrist strap as shown in FIG. 1 will not reach a lower grasp location such as this.

Figure 6:
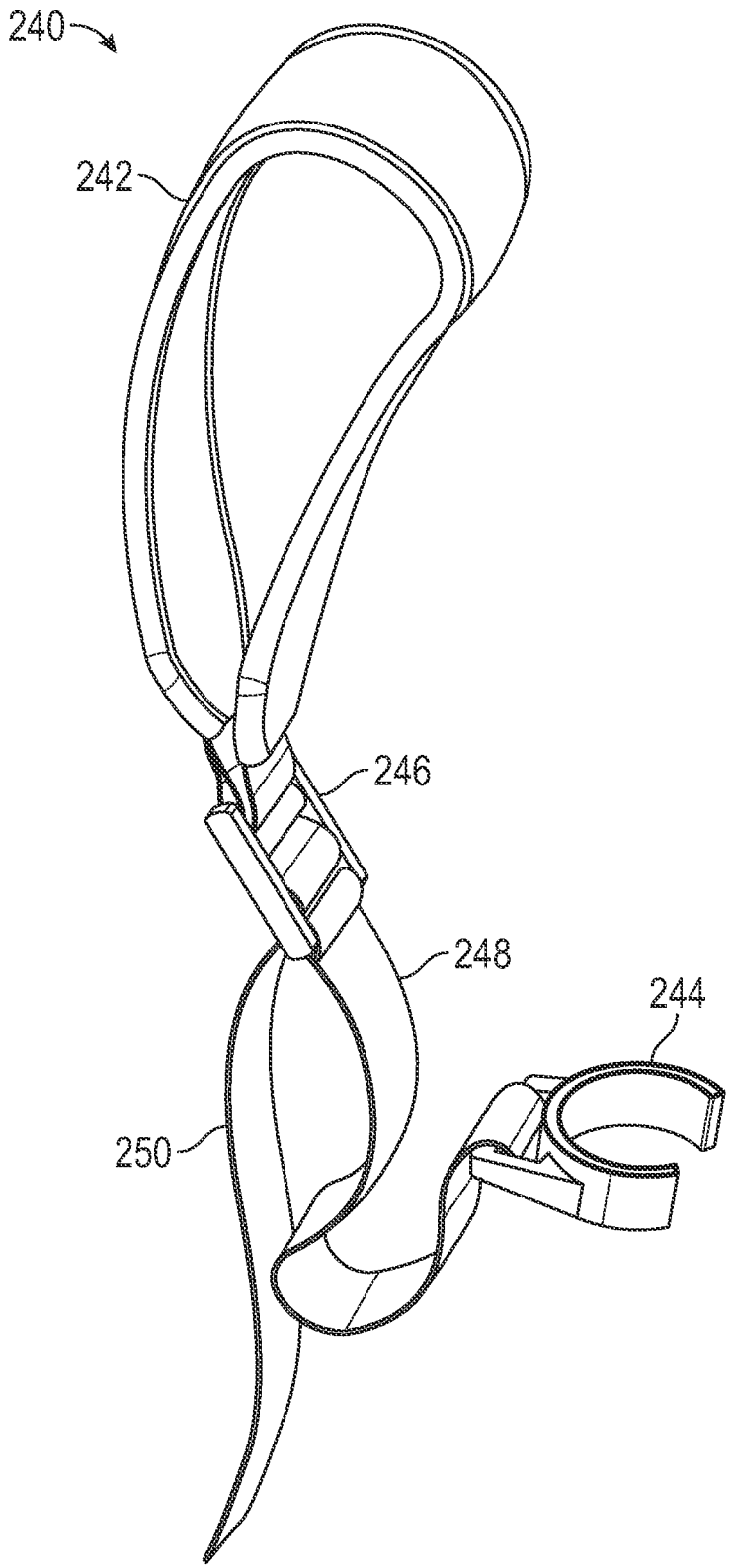
FIG. 6 is an illustration of the break-away wrist strap of the pole grip system, according to an embodiment of the present disclosure.

FIG. 6 is an illustration of the break-away wrist strap 240 of the pole grip system 200, according to an embodiment of the present disclosure. The break-away wrist strap 240 includes the loop portion 242, the clip 244 and the buckle 246 as mentioned earlier. A key feature of the wrist strap 240 is that it will break away (detach) from the pole 260 in the event of a moderate to hard pull on the clip 244. The break-away feature of the wrist strap 240 is made possible by the fact that the wrist strap 240 is not used to apply a downward force to the pole as in conventional grips and wrist straps of the type shown in FIG. 1. The conical shape of the primary grip 210 provides the pole thrust mechanism directly from the user's hand, which eliminates the need to use the wrist strap to assist in applying force to the pole, which in turn enables the break-away feature. The clip 244 is a preferred means of attaching the wrist strap 240 to the pole 260; however, any attachment means which supports light tension forces (such as using the wrist strap 240 to carry the pole 260), but breaks away under higher tension force, may be used.

The fact that the wrist strap 240 is not used to apply a downward force to the pole 260 also allows the wrist strap 240 to be attached at the bottom of the primary grip 210 rather than at the top of the grip and pole. Attachment of the wrist strap 240 at the bottom of the primary grip 210 enables the wrist strap 240 to be used when grasping the ascent grip 230 as well as the primary grip 210.

With the pole grip system 200, the wrist strap 240 is used essentially as a "keeper" strap—that is, to keep the pole 260 in position near the hand of the user even when the user releases her/his grasp on the primary grip 210 and the ascent grip 230. The user may wish to ungrasp but maintain control of the pole 260 for many reasons—such as moving the hand to a new grasp position (including switching between the primary grip 210 and the ascent grip 230), removing a glove and/or operating a mobile device, gesturing, etc. The wrist strap 240 also may be removed during pole usage and replaced during storage.

The wrist strap 240 is preferably comprised of a single piece of a strap material such as nylon webbing, along with the clip 244 and the buckle 246. The buckle 246 is preferably a compound buckle of a type which provides adjustability of the size of both the loop portion 242 and an extension portion 248. Using the buckle 246, the size of the loop portion 242 can be adjusted to just fit over the hand/glove of the user, where the size of the loop portion 242 will need to be considerably larger for a large man than for a small woman or a child. Similarly, different users may have different preferences for the length of the extension portion 248, which dictates the amount of slack that is present between the pole 260 and the user's wrist. In one embodiment, the length of the extension portion 248 is first set by adjusting the buckle 246 relative to the clip 244, where this first adjustment affects the length of the loop portion 242 as strap material is fed one direction or the other through the buckle 246. The length of the loop portion 242 can then be adjusted by feeding a free strap end 250 one direction or the other through the buckle 246. Other adjustment means besides the buckle 246 as described above may be suitable, with a strong preference for the independent adjustability of both the loop portion 242 and the extension portion 248. In some embodiments the extension portion 248 is a set length that is not adjustable and relies on the adjustability of the loop portion 242 to comfortably fit the loop around the wrist.

The loop portion 242 may include padding over the strap material to increase user comfort. In a preferred embodiment, the clip 244 is captured in a small fixed loop which is sewn into an end of the extension portion 248. The clip 244 is a simple, reliable and cost effective means of detachably coupling the wrist strap 240 to the pole 260. However, other detachable coupling means may be used as suitable.

As mentioned earlier, the break-away wrist strap 240 may be removed from the pole 260 in situations where the wrist strap 240 is not needed or wanted. As such, the break-away wrist strap 240 is an optional component of the pole grip system 200. Additionally, the break-away wrist strap 240 may be provided separately and utilized with a user's existing pole, where the break-away feature and the ability to connect the strap to the pole below the main grip provide advantages over existing wrist straps.

As detailed above, the pole grip system of the present disclosure provides many advantages over existing hand grips for skiing, hiking and trekking poles. The disclosed pole grip system features a conical grip which is designed to match the natural anatomical shape of the user's grasp. This conical grip shape reduces hand fatigue, and also enables the user to apply an axial force along the length of the pole without requiring excessive squeezing effort. The optimized grip shape in turn enables the wrist strap to be redesigned for user comfort, convenience, operational flexibility and safety. Other shape features of the primary grip, plus an optional ascent grip, deliver even more advantages over existing pole grip designs.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A pole grip comprising a primary grip element including a grip body having a conical shape with a smaller diameter first end and a larger diameter second end, where the grip body is fitted over a top end of a pole with the second end nearer a bottom tip of the pole, and the primary grip element has a grip top positioned above the first end of the grip body, the grip top having a rounded top surface blending into a rear face of the conical shape at the first end of the grip body with no overhang, and a front flange overhanging a front face of the grip body.

2. The pole grip according to claim 1 wherein the primary grip element has a length, including the grip top, in a range from 4.0-6.5 inches.

3. The pole grip according to claim 1 wherein the grip body has an outside diameter at the first end in a range from 0.75-1.25 inches, and the outside diameter increases continuously along a length of the grip body from the first end to the second end.

4. The pole grip according to claim 1 wherein the conical shape of the grip body has a cone angle in a range from 100-35°.

5. The pole grip according to claim 1 wherein the primary grip element is constructed of one or more materials selected from a group including natural or synthetic rubbers, foams, other elastomers, and cork.

6. The pole grip according to claim 5 wherein the material used for the grip body has an exterior surface which is tacky to the touch.

7. The pole grip according to claim 1 wherein the primary grip element is formed as a single part including the grip body and the grip top.

8. The pole grip according to claim 1 wherein the primary grip element is formed in two parts, where a first part includes the grip top and a pole coupler tube configured to fit over the pole, and a second part includes the grip body configured to fit over the pole coupler tube.

9. The pole grip according to claim 1 wherein the primary grip element has a recess formed into the second end of the grip body, where the recess has a size and shape configured to receive a finger of a user's hand which is wrapped around the grip body.

10. The pole grip according to claim 1 wherein the primary grip element has a spiral-shaped groove traversing an exterior surface continuously from the first end to the second end of the grip body.

11. The pole grip according to claim 1 further comprising a wrist strap detachably coupled to the pole below the primary grip element at a location proximal the second end of the grip body.

12. The pole grip according to claim 11 wherein the wrist strap includes a strap element comprised of flexible webbing material, the strap element being configured with a wrist loop and an extension from the wrist loop to a clip element attached to an end of the strap element, said clip element being configured to detachably couple the wrist strap to the pole.

13. The pole grip according to claim 1 further comprising a secondary grip element positioned below the primary grip element on the pole, the secondary grip element having a conical shape over most of its length, with a smaller diameter located at a top end proximal the primary grip element.

14. The pole grip according to claim 1 wherein the pole is configured for use in an activity including one or more of hiking, trekking, walking, snow skiing, and splitboarding.

15. A grip system for a pole, said grip system comprising:

a primary grip element including a grip body having a conical shape with a smaller diameter first end and a larger diameter second end, where the grip body is fitted over a top end of a pole with the second end nearer a bottom tip of the pole, and the primary grip element has a grip top positioned above the first end of the grip body, the grip top having a rounded top surface blending into a rear face of the conical shape at the first end of the grip body with no overhang, and a front flange overhanging a front face of the grip body, and where the primary grip element has a recess formed into the second end of the grip body, where the recess has a size and shape configured to receive a finger of a user's hand which is wrapped around the grip body; and a wrist strap detachably coupled to the pole by a clip which connects to the pole at a location proximal the second end of the grip body.

16. The grip system according to claim 15 wherein the primary grip element has a length including the grip top in a range from 4.0-6.5 inches, the grip body has an outside diameter at the first end in a range from 0.75-1.25 inches and the outside diameter increases continuously along a length of the grip body from the first end to the second end, and the conical shape of the grip body has a cone angle in a range from 10°-35°.

17. The grip system according to claim 15 wherein the primary grip element is constructed of one or more materials selected from a group including natural or synthetic rubbers, foams, other elastomers, and cork.

18. The grip system according to claim 15 wherein the primary grip element is formed as a single part including the grip body and the grip top, or the primary grip element is formed in two parts, where a first part includes the grip top and a pole coupler tube configured to fit over the pole, and a second part includes the grip body configured to fit over the pole coupler tube.

19. The grip system according to claim 15 wherein the primary grip element has a spiral-shaped groove traversing an exterior surface continuously from the first end to the second end of the grip body.

20. The pole grip according to claim 15 wherein the wrist strap includes a strap element comprised of flexible webbing material, the strap element being configured with a wrist loop and an extension from the wrist loop to the clip attached to an end of the strap element, said clip being configured to detachably couple the wrist strap to the pole.

21. The grip system according to claim 15 further comprising a secondary grip element positioned below the primary grip element on the pole, the secondary grip element having a conical shape over most of its length, with a smaller diameter located at a top end proximal the primary grip element.

22. A grip system for a pole, said grip system comprising:

a primary grip element including a grip body having a conical shape with a smaller diameter first end and a larger diameter second end, where the grip body is fitted over a top end of a pole with the second end nearer a bottom tip of the pole, and the primary grip element has a grip top positioned above the first end of the grip body, the grip top having a rounded top surface blending into a rear face of the conical shape at the first end of the grip body with no overhang, and a front flange overhanging a front face of the grip body, and where the primary grip element has a recess formed into the second end of the grip body, where the recess has a size and shape configured to receive a finger of a user's hand which is wrapped around the grip body;

a secondary grip element positioned below the primary grip element on the pole, the secondary grip element having a conical shape over most of its length, with a smaller diameter located at a top end proximal the primary grip element; and a wrist strap detachably coupled to the pole by a clip which connects to the pole at a location between the primary grip element and the secondary grip element.

* * * * *